US008096066B2

(12) United States Patent
Gandolfi

(10) Patent No.: US 8,096,066 B2
(45) Date of Patent: Jan. 17, 2012

(54) EXTENSIBLE SNOWPLOUGH BLADE

(75) Inventor: Fabio Gandolfi, Lizzano In Belvedere (IT)

(73) Assignee: Assaloni.com S.p.A., Lizzano in Belvedere, Bologna (IT)

( * ) Notice: Subject to any disclaimer, the term of this patent is extended or adjusted under 35 U.S.C. 154(b) by 0 days.

(21) Appl. No.: 12/676,136

(22) PCT Filed: Sep. 23, 2008

(86) PCT No.: PCT/IB2008/002475
§ 371 (c)(1),
(2), (4) Date: Mar. 2, 2010

(87) PCT Pub. No.: WO2009/040630

PCT Pub. Date: Apr. 2, 2009

(65) Prior Publication Data

US 2010/0199527 A1 Aug. 12, 2010

(30) Foreign Application Priority Data

Sep. 25, 2007 (IT) ..... BO2007A0654

(51) Int. Cl.
*E01H 5/06* (2006.01)

(52) U.S. Cl. ..... 37/274; 37/281; 172/815

(58) Field of Classification Search ..... 37/274, 37/281, 903, 255, 279; 172/782, 815, 816, 172/786

See application file for complete search history.

(56) References Cited

U.S. PATENT DOCUMENTS

| | | | | |
|---|---|---|---|---|
| 2,218,512 | A * | 10/1940 | Ball | 37/279 |
| 3,807,064 | A * | 4/1974 | Schmidt, Jr. | 37/283 |
| 4,073,077 | A * | 2/1978 | Essel et al. | 37/281 |
| 4,369,847 | A * | 1/1983 | Mizunuma | 172/815 |
| 4,667,426 | A * | 5/1987 | Howard et al. | 37/232 |
| 5,109,618 | A | 5/1992 | Gruebler et al. | |
| 5,392,538 | A | 2/1995 | Geerligs et al. | |
| 5,638,618 | A | 6/1997 | Niemela et al. | |
| 5,749,114 | A * | 5/1998 | Miller et al. | 15/93.1 |
| 5,899,007 | A * | 5/1999 | Niemela et al. | 37/281 |
| 5,921,326 | A * | 7/1999 | Ragule | 172/815 |
| 6,408,549 | B1 * | 6/2002 | Quenzi et al. | 37/281 |
| 6,442,877 | B1 * | 9/2002 | Quenzi et al. | 37/281 |
| 6,877,258 | B2 * | 4/2005 | Frey | 37/281 |
| 7,429,158 | B2 * | 9/2008 | McFarland | 414/722 |
| 7,578,078 | B2 * | 8/2009 | Gandolfi | 37/281 |
| 7,640,682 | B1 * | 1/2010 | Buckbee | 37/281 |
| 7,681,337 | B2 * | 3/2010 | Watson | 37/281 |
| 2003/0226289 | A1 * | 12/2003 | Geerligs | 37/268 |

FOREIGN PATENT DOCUMENTS

| | | |
|---|---|---|
| DE | 20117883 U1 | 2/2002 |
| EP | 1840272 A | 10/2007 |

OTHER PUBLICATIONS

International Search Report, Mar. 2, 2010.

* cited by examiner

*Primary Examiner* — Robert Pezzuto
*Assistant Examiner* — Jamie L McGowan
(74) *Attorney, Agent, or Firm* — William J. Sapone; Coleman Sudol Sapone P.C.

(57) ABSTRACT

An extensible snowplough blade comprises a fixed blade body (10), having a substantially linear conformation in a longitudinal direction and is provided, at a posterior surface (11) thereof, with means for support (12). It further comprises a raising structure (20) for defining a hinged connection between the blade body (10) and a vehicle (150). The raising structure (20) in turn comprises a frame (21) for fixing thereof to the vehicle (150) and coupling means (25) of the fixed frame (21) to the means for support (12). The extensible snowplough blade (100) further comprises a first extension (30), slidably mounted on the means for support (12) in a parallel position to the blade body (10) and destined to extend longitudinally with respect to the blade body (10) in a left-wards direction, and a second extension (40), slidably mounted on the means for support (12) in a parallel position to the blade body (10) and destined to extend longitudinally, with respect to the blade body (10), in a right-wards direction. Adjusting means (6) are further provided in the raising structure (20) in order to regulate an angle of incidence to the ground of the snowplough blade (100).

10 Claims, 5 Drawing Sheets

EXTENSIBLE SNOWPLOUGH BLADE

TECHNICAL FIELD

The invention relates to the technical field of snowplough blades, i.e. apparatus for removing snow from the ground; these apparatus are mounted on suitably-equipped vehicles (lorries, agricultural tractors, other work machines) and are predisposed to regulate the breadth of their operative frontal dimension according to the characteristics of the road surfaces to be freed, and other contingent requirements, such as for example the need to operate in parallel with other similar apparatus

BACKGROUND ART

Various types of snowplough blades with adjustable breadth are known to experts in the sector, and substantially comprise a fixed blade body, hinged on a support and raising structure. This structure is provided with dampers destined to absorb the impacts of the blade during its advancement, and is fixed to the front part of the vehicle.

The blade body is further provided, in the lower part thereof, with a flexible cutter operating in contact with the ground. The cutter is mounted on the blade body with the interposing of damped attachment organs, and is destined to absorb impacts against obstacles or bumps on the road surface. An extension is mounted at an end of the blade body, hinged on the side of the blade body and destined to be opened and closed book-fashion, in order to increase or reduce the breadth of the blade.

In a further regulation mode, an extension of the blade itself is mounted in the posterior part of the blade body, which blade is slidable with respect to the fixed blade body in a substantially parallel direction to the extension of the fixed blade body.

The extension is made mobile by suitable actuators, generally hydraulic jacks, between a closed position, in which it retracts substantially completely into the area of the fixed blade body, and an open position, in which it extends beyond the blade body, in order to increase the breadth of the operating front of the snowplough blade.

The prior art comprises left-side or right-side extensions of the fixed blade body. Each of the configurations facilitates the removal operations, especially in certain conditions. In particular, a left-side extension enables the snowplough machine to cope with varied lane widths, while a right-side extension is useful for removing snow from the recesses in the lane itself, though while keeping the left side of the pathway cleared by the machine straight.

However, as the transversal positioning of the blade body with respect to the advancement direction of the vehicle is fixed, the above-cited configurations do not lead to optimal versatility, as they tend anyhow to unbalance the working front of the snowplough blade.

An aim of the present invention is to provide an extensible snowplough blade which can obviate the above-described drawbacks.

A further aim of the invention is to provide an extensible snowplough blade having an adjustable trim according to the transversal extension thereof.

DISCLOSURE OF INVENTION

The above-described aims are obtained, in agreement with the contents of the claims, by an extensible snowplough blade which comprises a fixed blade body having a substantially linear conformation in a longitudinal direction and being provided, at a posterior surface thereof, with means for support. It further comprises a raising structure, which defines a hinged connection between the blade body and a predisposed vehicle.

The raising structure in turn comprises a fixing frame for fixing to a specially predisposed vehicle, and means for coupling the frame to the means for support.

The extensible snowplough blade further comprises a first extension which is slidably mounted on the means for support in a parallel position to the blade body and is destined to extend longitudinally, with respect thereto, towards the left, and a second extension, slidably mounted on the means for support in a parallel position to the blade body and destined to extend longitudinally with respect thereto, towards the right.

An adjustable push-rod is further provided on the raising structure, for regulating the angle of incidence to the ground of the snowplough blade according to the vehicle trim and the operating position of the first and second extensions.

BRIEF DESCRIPTION OF THE DRAWINGS

The characteristics of the invention will better emerge from the following description, in accordance with what is comprised in the claims and with the aid of the accompanying figures of the drawings, in which:

BEST MODE FOR CARRYING OUT THE INVENTION

Figure 1:
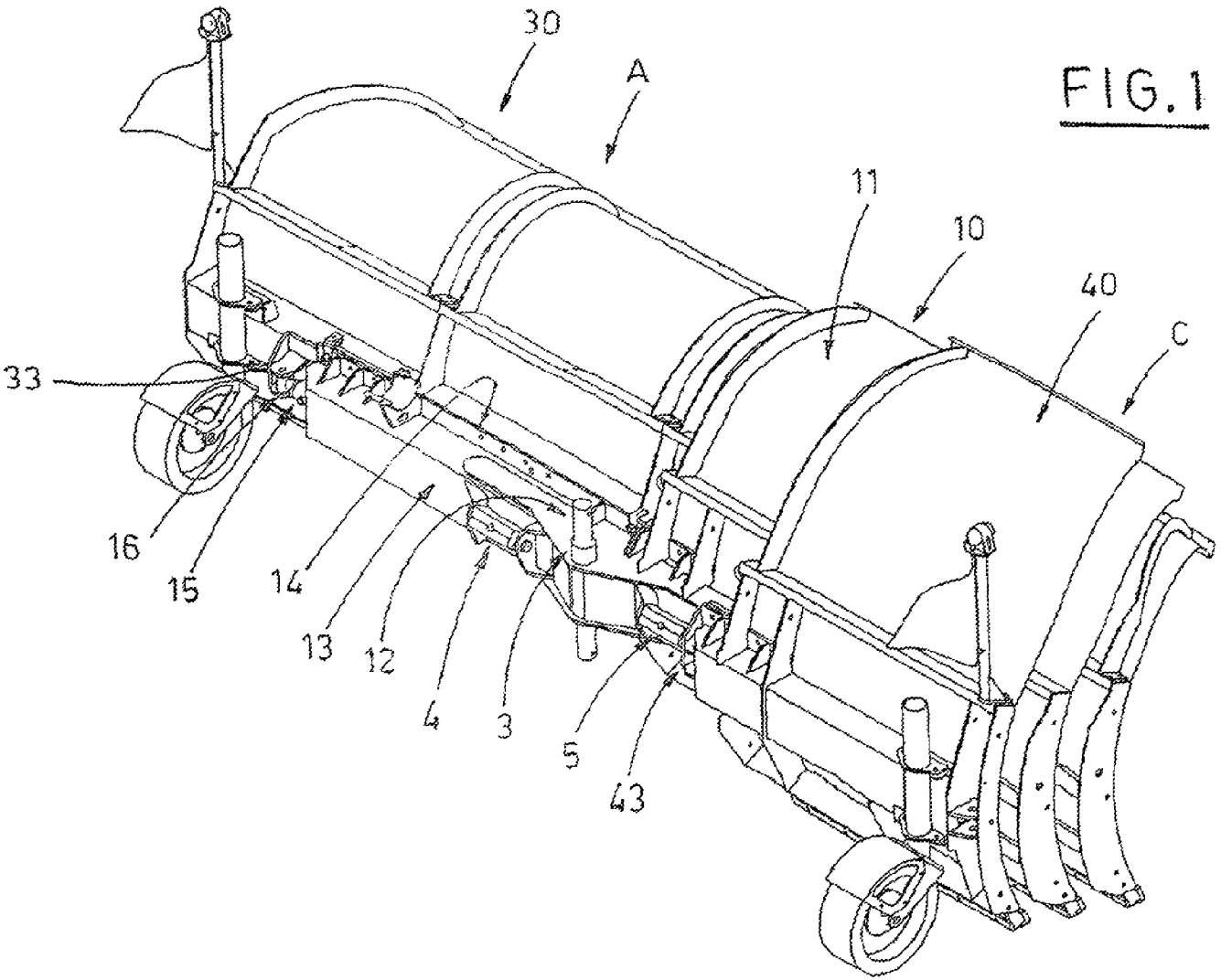
FIG. 1 is a perspective rear three-quarter view of a snowplough blade realised according to the present invention, in a totally retracted position.
Figure 2:
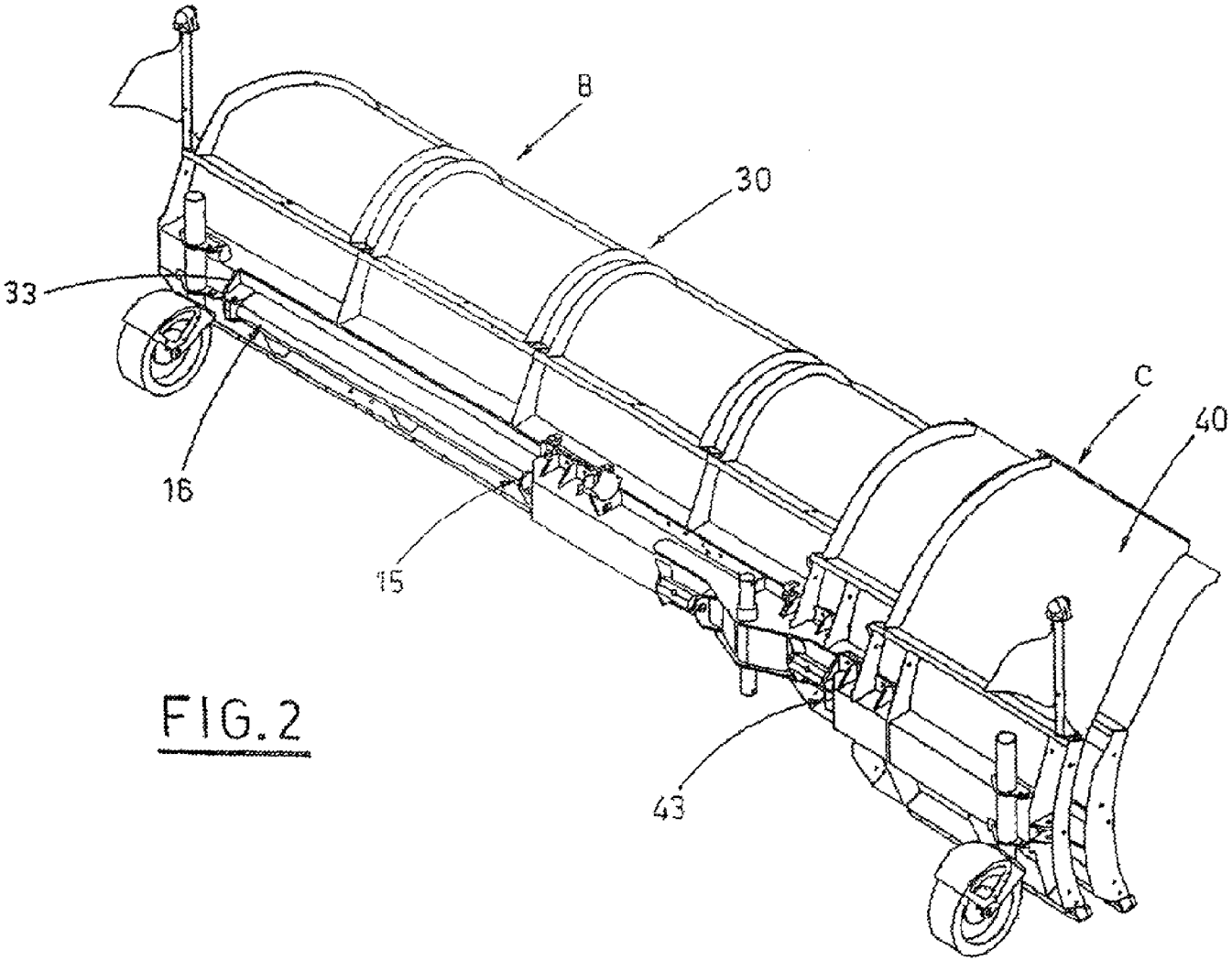
FIG. 2 is a perspective view of the snowplough blade of FIG. 1, with the left-side extension in a position of maximum opening.
Figure 3:
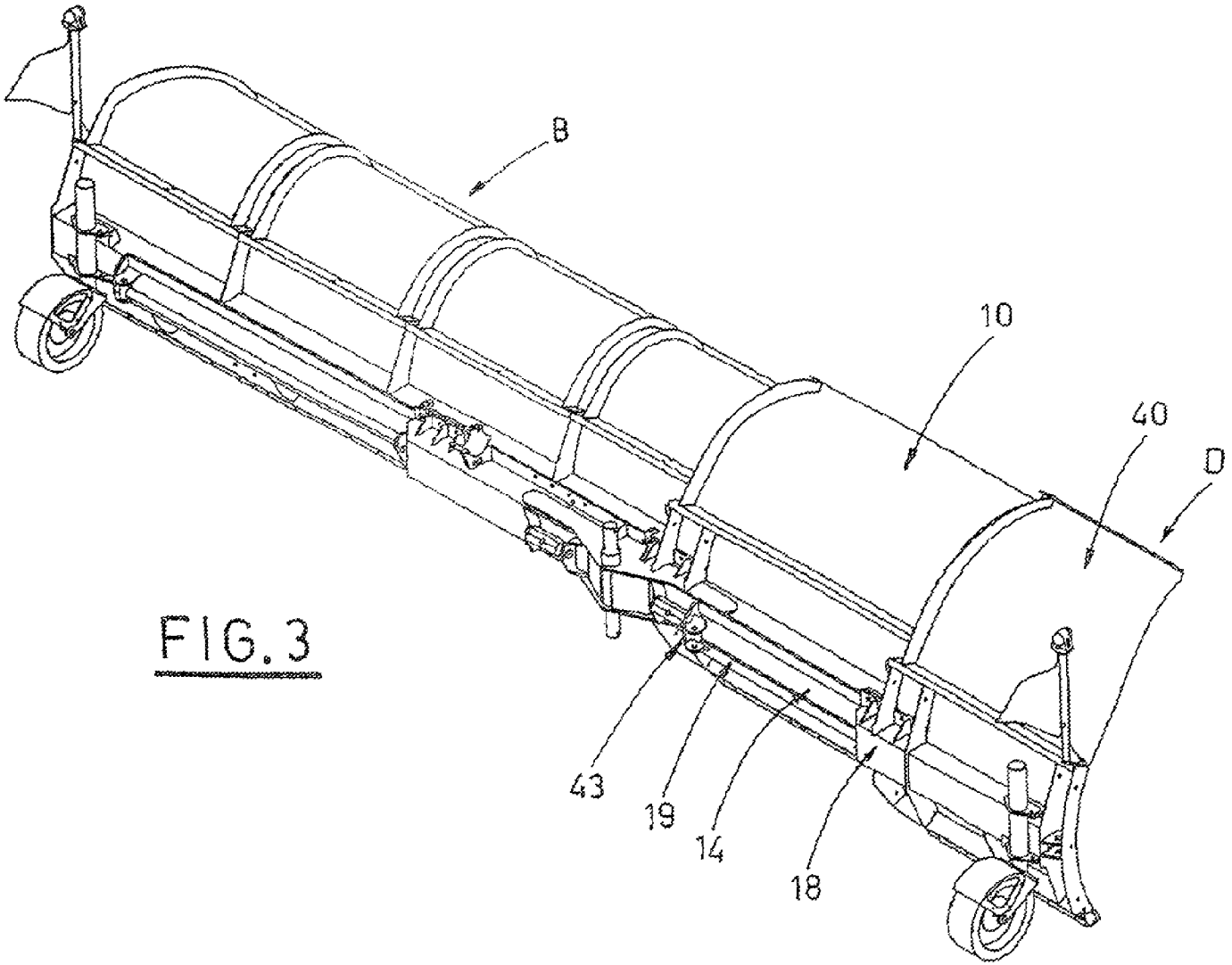
FIG. 3 is a perspective view of the snowplough blade of FIG. 1, with both the left- and right-side extension in positions of maximum opening.

With reference to the above-described figures, 100 denotes, in its entirety, an extensible snowplough blade realised according to the present invention. In particular, figures from 5A to 5D are schematic views of a snowplough blade 100 mounted on a specially-predisposed vehicle 150, for example a lorry, a tractor or another suitable work machine, by means of a raising structure 20, in the various operating configurations thereof.

The snowplough blade 100 comprises a fixed blade body 10 which, like the majority of conventional snowplough blades, has a substantially linear conformation in a longitudinal direction, and is arched going from bottom to top, in order to facilitate the collection and shifting of the snow from the ground.

Although the structure and conformation of the snowplough blade 100 are rather complex, in the present description detailing will be substantially limited to the characteristics that pertain to the present invention, to facilitate understanding thereof, leaving aside the details relating to the prior art and which do not relate to the invention, or in any case which are not essential for actuation thereof.

The fixed blade body 10 exhibits a limited extension and is provided, at the posterior surface thereof 11, with means for support 12, destined to enable a coupling of the blade body 10 to the vehicle 150 and for supporting a first extension 30 and a second extension 40, as will be better detailed herein below.

The means for support 12 comprise (see figures from 1 to 3) a beam 13, having a substantially longitudinal extension, fixed to the posterior surface of the blade body 10. The beam 13 extends on the left side of the blade body 10. In the part extending outside of the dimensions of the blade body 10, the beam 13 exhibits, at the front surface thereof, a first slide 14, destined to slidably receive the first extension 30.

The beam 13 further comprises, in the front surface thereof, and at the part comprised within the overall body of the blade body 10, a second slide 14, which is destined to slidably receive the above-cited second extension 40.

In the central part of the posterior surface of the beam 13 there are a central pivot 3 and a pair of lateral connectors 4, 5, destined to couple the blade body 10 with the raising structure 20 in known ways.

Figure 5A:
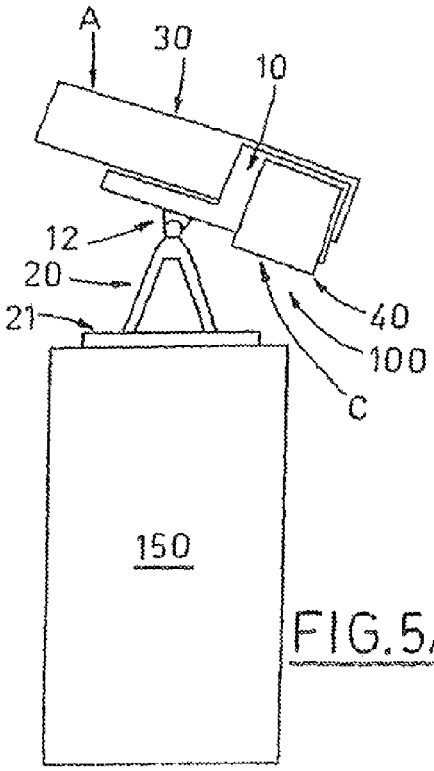
FIGS. 5A, 5B, 5C, 5D schematically illustrate four views from above of a vehicle provided with the snowplough blade of the invention, in the possible extreme operating positions.
Figure 5B:
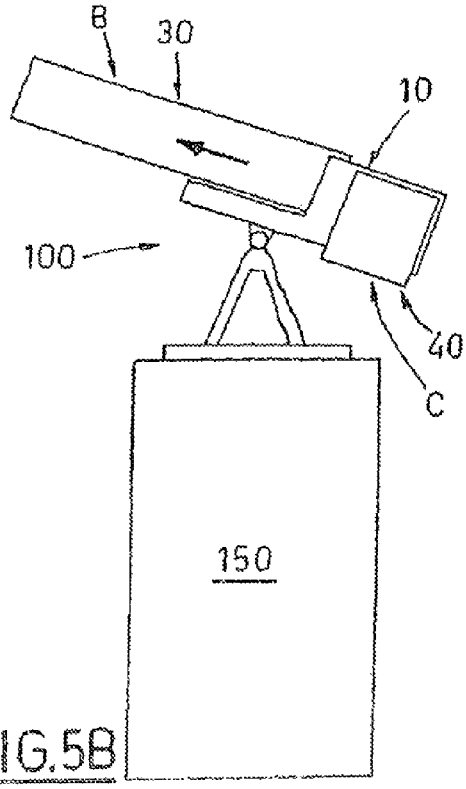
Figure 5C:
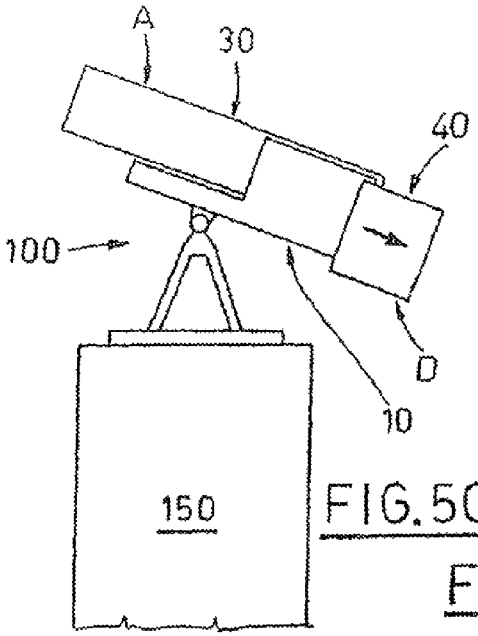
Figure 5D:
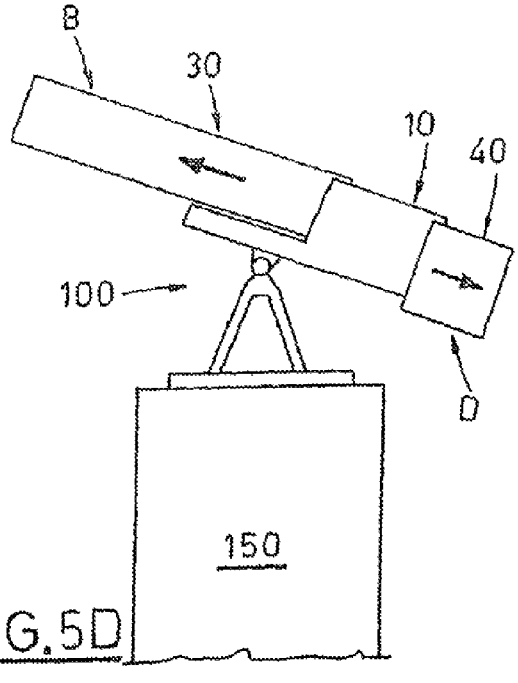

The above-cited first extension 30, slidably mounted on the beam 13, is arranged parallel to the blade body 10, in a front position with respect thereto, and is destined to extend longitudinally towards the left side, between a closed position A (FIGS. 1, 5A and 5C) and an open position C (FIGS. 2, 3, 5B and 5D). In the illustrated embodiment, the first extension 30 is larger than the blade body 10, such that when in the closed position A the first extension is completely superposed on the first blade body 10.

When in the open position B, the first extension 30 uncovers the blade body 10, and cooperates there-with in order to increase the working size of the snowplough blade 100 towards the left.

In particular, in the illustrated embodiment, in the closed position A the first extension 30 is completely superposed on the blade body 10. In this situation it becomes the sole operating element of the snowplough blade 100. A first hydraulic jack 15 is mounted longitudinally in the beam 13. A free end of a piston 16 of the jack 15 is engaged in a bracket 33 realised in the posterior surface of the first extension 30. The activation of the first jack 15, on command of a control panel, not illustrated, causes the first extension 30 to slide alternatively between the closed position A and the open position B, and positions the first extension 30 in any one of the above-mentioned extreme positions.

Similarly, the second extension 40 is slidably mounted on the second slide 14 of the beam 13, posteriorly with respect to the blade body 10 and parallel thereto. The second extension 30 is in turn mobile between a closed position C (FIGS. 1, 5A and 5B), in which it is entirely covered by the blade body 10, and an open position D (FIGS. 3, 5C and 5D), in which it extends beyond the blade body 10, increasing the working surface of the snowplough blade 100 rightwards.

A second hydraulic jack 18 is mounted longitudinally in the beam 13. A free and of the piston 19 of the jack 18 is engaged in a bracket 43 realised in the posterior surface of the second extension 40. The activation of the second jack 18, on command of the above-mentioned control panel, causes the second extension 40 to slide alternatively between the closed position C and the open position D, and the positioning of the second extension 40 in any position between the above-mentioned extreme positions.

Figure 4:
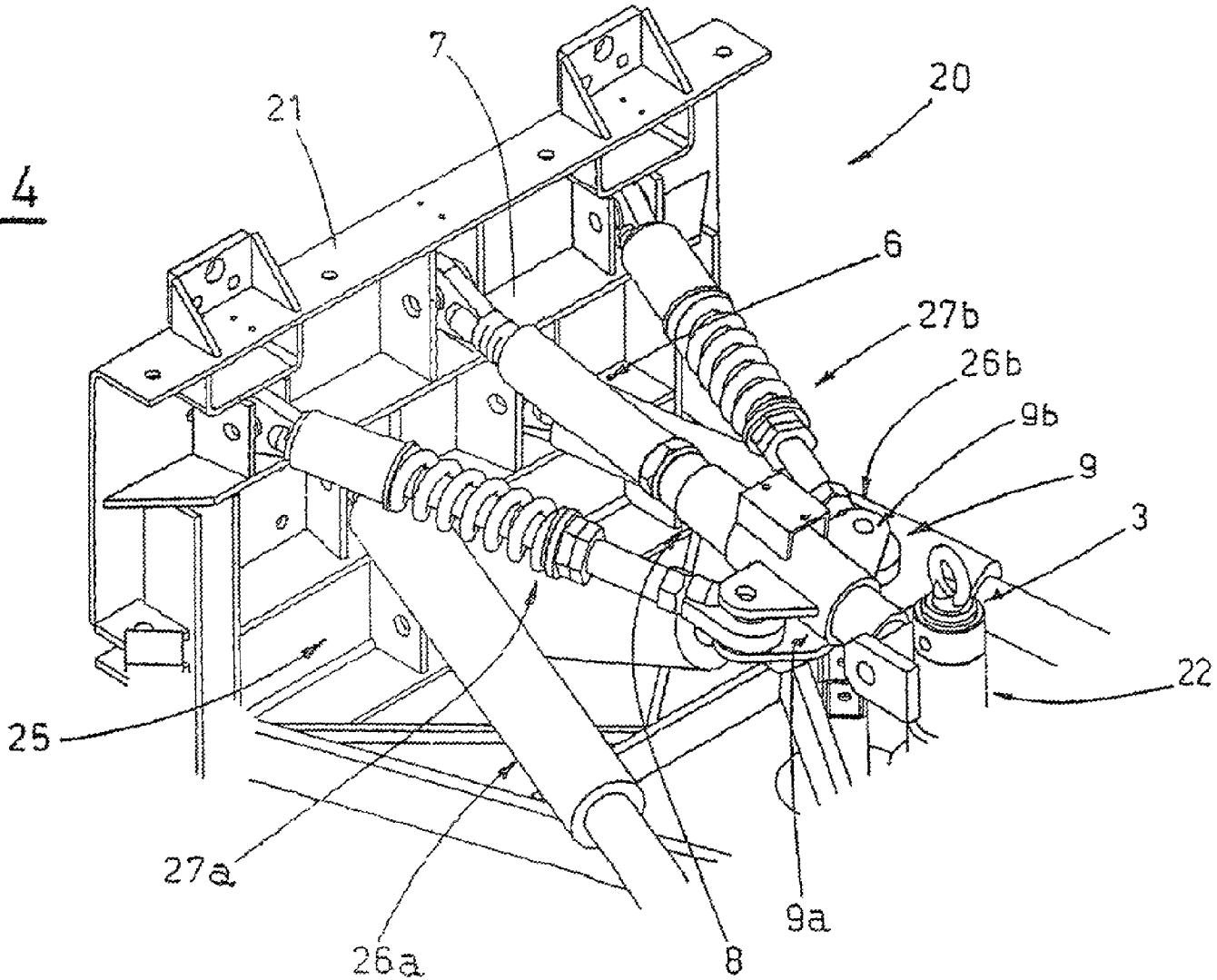
FIG. 4 is a perspective view of the raising structure of the snowplough blade of the preceding figures.

The raising structure 20 (see FIG. 4) comprises a frame 21, which in a known way fixes the snowplough blade 100 to the vehicle 150, and coupling means 25 of the frame 21 to the above-mentioned support means 12, and in particular to the pivot 3 and the lateral connectors 4, 5.

In particular, the coupling means 25 comprise, in a known way, a pair of hydraulic jacks 26*a*, 26*b*, arranged divergently to one another, and having ends connected to the frame 21, and, respectively, to the lateral connectors 4, 5.

An end of a push-rod 6 is hinged to the frame 21 at an intermediate position thereon between the attachments of the hydraulic jacks 26*a*, 26*b*. Another end of the push-rod 6 forms a sleeve 22 operatively inserted in the above-cited pivot 3 of the beam 13, in order to enable the snowplough blade 100 to oscillate parallel to the ground.

In the present invention, the push-rod 6 is adjustable in length, in order to regulate the angle of incidence to the ground of the snowplough blade 100, mainly in accordance with the vehicle 150 trim. In particular, different bearing-vehicle trims can give rise to different angulation of the blade body and the first and second extensions thereof with respect to the ground, causing them to work inhomogeneously. The adjustable push-rod 6 is destined to compensate for these trim differences, in order to guarantee that the parts of the snowplough blades 100 always operate at a same height.

The adjustable push-rod 6 is made in two parts, respectively an internal part 7 and an external part 8, telescopically engaged to one another and constrained to one another by a threaded coupling.

The coupling means 25 further comprise a pair of dampers 27*a*, 27*b*, arranged convergingly to one another and having ends connected to respective forks 9*a*, 9*b* of a support 9. The support 9 is in turn fixed to the adjustable push-rod 6 in proximity of the end thereof provided with the sleeve 22.

The functioning of the snowplough blade 100, in relation to the present invention, is clearly deducible from the above structural description, and will not be further explained herein. Reference is made exclusively to the fact that the above-described structure advantageously enables regulating the snowplough blade 100 configuration completely safely, even during normal activity thereof, and even with the vehicle 150 in motion.

The advantages of the invention primarily consist in the almost-total versatility and adaptability of the snowplough blade 100 in all possible conditions of the surface to be cleared.

Secondly, a further advantage is given by the possibility of always defining the optimal trim of the snowplough blade 100 according to the arrangement of the extensions, and thus the overall size of the blade.

A further advantage is given by the possibility of regulating the configuration of the snowplough blade even during the snow removal operations, without any negative effects on the safety of the apparatus and the surrounding environment.

The above is given purely by way of non-limiting example, and any variants of a practical-applicational nature are considered to fall within the ambit of protection as described above and as claimed herein below. For example, a configuration of a snowplough blade 100 being a mirror-image of what is described herein, and more suitable, for example, for operations in countries where users drive on the left of the road, would certainly be included in the ambit of the present invention.

The invention claimed is:

1. An extensible snowplough blade, comprising:

a fixed blade body (10) having a substantially linear conformation in a longitudinal direction and being provided, at a posterior surface (11) thereof, and having means for support (12) thereof, a raising structure (20) for defining a hinged connection between the blade body (10) and a vehicle (150), the raising structure (20) in turn comprising a frame (21) for fixing the structure (20) to the vehicle (150), and coupling means (25) for coupling the fixed frame (21) to the means for support (12), a first extension (30), slidably mounted on the means for support (12) in a parallel position to the blade body (10) and being located in front of the blade body (10) and being variably extendable longitudinally with respect to the blade body (10) in a left-wards direction, a second extension (40), slidably mounted on the means for support (12) in a parallel position to the blade body (10) and being located in back of the blade body and being variably extendable longitudinally, with respect to the blade body (10), in a right-wards direction, and adjusting means (6) provided in the raising structure (20) in order to regulate an angle of incidence relative to the ground of the snowplough blade (100), wherein the first extension (30) is larger than the blade body and is extendable longitudinally between a closed position (A) in which the first extension completely covers the blade body and provides to the total working size of the snowplough blade (100) and an open position (B), in which the first extension uncovers the blade body (10) and cooperates therewith to increase a working size of the snowplough blade (100) towards the left.

2. The snowplough blade of claim 1 wherein the means for support (12) comprise a beam (13), fixed to the posterior surface of the blade body (10) and extending on a left side thereof, the beam (13) comprising, in a front surface thereof, a left slide (14) which slidably receives the first extension (30).

3. The snowplough blade of claim 1 further comprising a first hydraulic jack (15) longitudinally mounted in the beam (13), a free end of a piston (16) of the jack (15) being engaged in a bracket (33) located in the posterior surface of the first extension (30), for slidingly displacing the first extension (30) in the longitudinal direction.

4. The snowplough blade of claim 1 wherein the means for support (12) comprise a beam (13), fixed to the posterior surface of the blade body (10) and extending on a right side thereof, the beam (13) having, in the posterior surface of the beam (13), a right slide (14) for slidingly receiving the second extension (40).

5. The snowplough blade of claim 1 wherein the second extension (40) is longitudinally movable between a closed position (C), in which the second extension is entirely covered by the blade body (10), and an open position (D), in which the second extension extends beyond a right end of the blade body (10), increasing a working surface of the snowplough blade (100) in a right-wards direction.

6. The snowplough blade of claim 1 further comprising a second hydraulic jack (18) mounted longitudinally in the beam (13), a free end of a piston (19) of the second hydraulic jack (18) being engaged in a bracket (43) located in the posterior surface of the second extension (40) in order to slidingly displace the second extension in the longitudinal direction.

7. The snowplough blade of claim 1, wherein the adjusting means (6) are constituted by an adjustable push-rod operating between the frame (21) and a sleeve (22) of the raising structure (20) for enabling hinging of the blade body (10), the push-rod (6) being composed of at least two parts (7, 8) engaged telescopically to one another, and constrained to one another by a threaded coupling, for adjusting an overall length of the push-rod (6).

8. The snowplough blade of claim 2 further comprising a first hydraulic jack (15) longitudinally mounted in the beam (13), a free end of a piston (16) of the jack (15) being engaged in a bracket (33) located in the posterior surface of the first extension (30), for slidingly displacing the first extension (30) in the longitudinal direction.

9. The snowplough blade of claim 4 wherein the second extension (40) is longitudinally movable between a closed position (C), in which the second extension is entirely covered by the blade body (10), and an open position (D), in which the second extension extends beyond a right end of the blade body (10), increasing a working surface of the snowplough blade (100) in a right-wards direction.

10. The snowplough blade of claim 4 further comprising a second hydraulic jack (18) mounted longitudinally in the beam (13), a free end of a piston (19) of the second hydraulic jack (18) being engaged in a bracket (43) located in the posterior surface of the second extension (40) in order to slidingly displace the second extension in the longitudinal direction.

* * * * *